United States Patent [19]

Lau

[11] 4,401,752

[45] Aug. 30, 1983

[54] ARYLOXY SUBSTITUTED PHOTOGRAPHIC COUPLERS AND PHOTOGRAPHIC ELEMENTS AND PROCESSES EMPLOYING SAME

[75] Inventor: Philip T. S. Lau, Rochester, N.Y.

[73] Assignee: Eastman Kodak Company, Rochester, N.Y.

[21] Appl. No.: 324,237

[22] Filed: Nov. 23, 1981

[51] Int. Cl.[3] ..... G03C 7/00; G03C 1/40

[52] U.S. Cl. ..... 430/385; 430/387; 430/389; 430/505; 430/553; 430/555; 430/557; 430/558

[58] Field of Search ..... 430/553, 555, 557, 385, 430/387, 389, 505, 558

[56] References Cited

U.S. PATENT DOCUMENTS

| | | | |
|---|---|---|---|
| 3,408,194 | 10/1968 | Loria | 430/548 |
| 3,419,391 | 12/1968 | Young | 430/476 |
| 3,822,248 | 7/1974 | Loria | 430/472 |
| 3,933,501 | 1/1976 | Cameron et al. | 430/505 |
| 4,248,962 | 2/1981 | Lau | 430/555 |
| 4,310,618 | 1/1982 | Fernandez et al. | 430/557 |

*Primary Examiner*—J. Travis Brown

*Attorney, Agent, or Firm*—Richard E. Knapp

[57] ABSTRACT

Couplers of good reactivity contain an aryloxy coupling-off group having in an ortho position a polarizable carbonyl, sulfonyl or phosphinyl substituent group which is free of photographic dye groups and photographic reagent groups.

18 Claims, No Drawings

ARYLOXY SUBSTITUTED PHOTOGRAPHIC COUPLERS AND PHOTOGRAPHIC ELEMENTS AND PROCESSES EMPLOYING SAME

This invention relates to nondiffusible photographic couplers and to silver halide photographic elements employing such couplers. In a particular aspect it relates to couplers containing a novel coupling-off group.

Images are commonly obtained in the photographic art by a coupling reaction between the development product of a silver halide developing agent (i.e., oxidized aromatic primary amino developing agent) and a color-forming compound referred to as a coupler. The dyes produced by coupling are indoaniline, azomethine, indamine, or indophenol dyes, depending upon the chemical composition of the coupler and the developing agent. The subtractive process of color formation is ordinarily employed in multicolored photographic elements and the resulting image dyes are usually cyan, magenta and yellow dyes which are formed in or adjacent silver halide layers sensitive to red, green and blue radiation, respectively.

Since this is a mature art, the patent and technical literature is replete with references to compounds which can be used as couplers for the formation of photographic images. Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531 and 3,041,236 and "Farbkuppler-ein Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067 and 2,908,573 and "Farbkupplereine Literaturubersicht," published in Agfa Mitteilungen, Band II, pp. 126–156 (1961).

Couplers which form yellow dyes upon reaction with oxidized color developing agent are acylacetanilides such as benzoylacetanilides and pivalylacetanilides. Representative couplers are described in the following patents and publications: U.S. Pat. Nos. 2,875,057, 2,407,210, 3,265,506, 2,298,443, 3,048,194 and 3,447,928 and "Farbkupplereine Literaturubersicht," published in Agfa Mitteilungen, Band II, pp. 112–126 (1961).

Also known are couplers which form black or neutral dyes upon reaction with oxidized color developing agent. Representative such couplers are resorcinols and m-aminophenols such as are described in U.S. Pat. Nos. 1,939,231, 2,181,944, 2,333,106, 4,126,461, German OLS No. 2,644,194 and German OLS No. 2,650,764.

Many of the color forming couplers employed in photographic materials are four-equivalent couplers. In other words, they require four molecules of oxidized developing agent, and development of four molecules of silver halide, in order to ultimately produce one molecule of dye. Also known and used are two-equivalent couplers which require only two molecules of oxidized developing agent, and development of two molecules of silver halide, to produce one molecule of dye.

Two-equivalent couplers contain a substituent in the coupling position, known as a coupling-off group, which is eliminated from the coupler following reaction with oxidized developing agent without requiring the action of two additional molecules of oxidized developing agent, as is required by four equivalent couplers.

Although numerous couplers are known in the art, there is a continuing search for novel couplers which improve upon existing couplers or optimize specific properties for a particular application. A particular property which frequently is of interest is reactivity. Reactivity relates to the rate at which the coupler reacts with oxidized color developing agent and it influences the dye density in the processed photographic image. While two-equivalent couplers are theoretically capable of yielding twice as much dye per unit of developed silver as four-equivalent couplers, they rarely, if ever, yield the amount of dye theoretically possible. The amount of dye obtained can be increased by increasing the reactivity of the coupler. One way of increasing reactivity is by modifying the coupling-off group.

This invention provides a novel class of couplers which have good reactivity and hence are capable of yielding high amounts of dye upon reaction with oxidized color developing agent. These couplers can be broadly defined as containing a coupling-off group which is an aryloxy group having ortho to the oxygen atom, a polarizable carbonyl, sulfonyl or phosphinyl substituent group which is free of photographic dye groups and photographic reagent groups.

Thus, in one embodiment this invention relates to novel dye-forming couplers.

In another embodiment this invention relates to photographic emulsions and elements containing these couplers.

In yet another embodiment this invention relates to processes of forming images in a photographic element by developing it in the presence of one of these couplers.

Dye-forming couplers containing aryloxy coupling-off groups are known in the art and are described in such patents as U.S. Pat. Nos. 3,408,194, 3,419,391, 3,429,391, 3,476,563, 3,644,498 and 3,822,248. While these patents indicate that the aryl group can be substituted, they do not recognize the significant effect on reactivity of the position of the substituent or the fact that it should contain a polarizable group. Substituents described in these patents which contain polarizable carbonyl or sulfonyl groups are either in undefined positions or in positions other than the ortho position. Substituents shown in the ortho position of these prior art compounds are outside the scope of this invention.

U.S. Pat. No. 4,248,962 describes couplers which release a photographic dye or reagent in a controlled manner as a function of silver halide development. In some instances the photographic dye or reagent is joined to the ortho position of an aryloxy coupling-off group and some intermediates shown in the preparative examples have ortho-substituted aryloxy coupling-off groups. As in the case of the patents discussed in the preceding paragraph, this patent does not suggest that a particular type of substituent in a particular position of a coupling-off group would have a significant effect on reactivity. The particular ortho-substituted coupling-off groups shown are outside the scope of this invention.

In one embodiment, this invention relates to novel dye forming couplers having the structural formula:

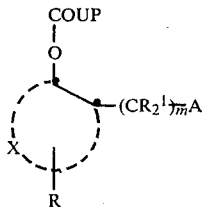

where:

COUP represents a dye-forming coupler moiety substituted in its coupling position with the remainder of the structure;

X represents the atoms to complete a phenyl or naphthyl nucleus;

R is hydrogen or one or more substituents, preferably a substituent selected from halogen, alkyl, alkoxy, nitro, cyano, carboxy, alkoxycarbonyl, aryloxycarbonyl, alkylsulfonyl, arylsulfonyl, amido ($-NR^1COR^2$), carbamoyl ($-CONR^3R^4$), sulfonamido ($-NR^1SO_2R^2$) and sulfamoyl ($-SO_2NR^3R^4$).

$R^1$ is hydrogen or alkyl of 1 to 4 carbon atoms;

m is 0 to 4;

A is a moiety containing a polarizable carbonyl, sulfonyl or phosphinyl group free of photographic dye groups and photographic reagent groups, preferably a moiety selected from $$-\overset{O}{\overset{\|}{C}}OR^2,\ -\overset{O}{\overset{\|}{C}}NR^3R^4,\ -\overset{O}{\overset{\|}{C}}NR^1NR^1\overset{O}{\overset{\|}{C}}NR^3R^4,\ -NR^1\overset{O}{\overset{\|}{C}}R^2,$$

$$-NR^1\overset{O}{\overset{\|}{C}}NR^3R^4,\ -SO_2R^2,\ -SO_2NR^3R^4,\ -NR^1SO_2R^2,$$

$$-NR^1SO_2NR^3R^4 \text{ and } -\overset{O}{\overset{\|}{P}}(R^5)_2;$$

$R^2$ is hydrogen, alkyl or aryl;

$R^3$ and $R^4$ are each, individually, hydrogen, alkyl, aryl or heterocyclyl, or together $R^3$ and $R^4$ complete a heterocyclic ring with the nitrogen atom to which they are attached; and each $R^5$ is, individually, alkyl, alkoxy, aryl or aryloxy.

Unless otherwise specified, the alkyl and aryl portions of the above groups contain 1 to 20 and 6 to 20 carbon atoms, respectively. They can be unsubstituted or substituted with such groups as halogen (e.g., chloro, bromo and fluoro), hydroxy, cyano, carboxy and sulfamoyl. The heterocyclic portions of the above groups contain at least one 5- or 6-membered ring comprised of ring atoms selected from carbon, oxygen, nitrogen and sulfur.

Especially preferred couplers of structural formula I, above, are those where:

X completes a phenyl group;

m is 0 or 1;

R is hydrogen or is a para position substituent selected from carboxy, alkoxy, alkoxycarbonyl, hydroxyalkyl and hydroxyalkylsulfamoyl;

$R^1$ is hydrogen;

A is $-NHCOR^2$, $CONR^3R^4$, $-SO_2R^2$, $-NHSO_2R^2$ or $-SO_2NR^3R^4$;

$R^2$ is alkyl or hydroxyalkyl of 1 to 4 carbon atoms; and one of $R^3$ and $R^4$ is hydrogen and the other is alkyl or hydroxyalkyl of 1 to 4 carbon atoms.

The coupler moiety represented by COUP can be any coupler moiety known or used in the art to form a colored reaction product with oxidized color developing agent. As indicated above, common yellow dye-forming couplers are acylacetanilides such as acetoacetanilides and benzoylacetanilides, common magenta dye-forming couplers are pyrazolones, pyrazolotriazoles, pyrazolobenzimidazoles and indazolones. Common cyan dye-forming couplers are phenols and naphthols, and common neutral dye-forming couplers are resorcinols and m-aminophenols. These couplers can form the coupler moiety, COUP in Formula I above. Structures of preferred coupler moieties are shown below. In these structures the unsatisfied bond indicates the position where the aryloxy coupling-off group of this invention is joined.

Yellow dye-forming coupler moieties:

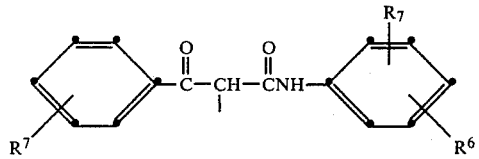

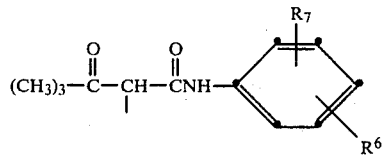

where:

$R^6$ is a ballast group and $R^7$ is hydrogen or one or more halogen, alkyl or alkoxy groups.

Cyan dye-forming coupler moieties:

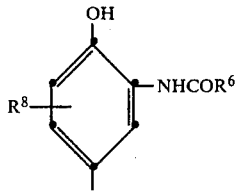

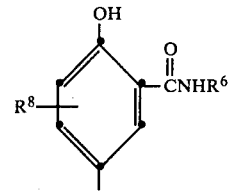

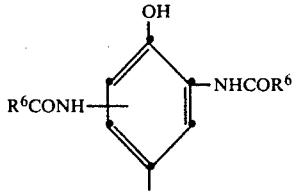

-continued

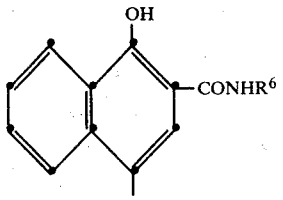

where:

$R^6$ is a ballast group, and $R^8$ is one or more halogen (e.g., chloro, fluoro), lower alkyl (e.g., methyl, ethyl, butyl) or lower alkoxy (e.g., methoxy, ethoxy, butoxy) groups.

Magenta dye-forming coupler moieties:

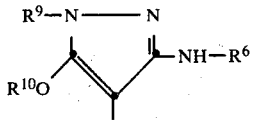

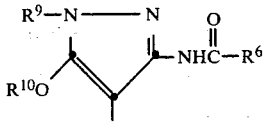

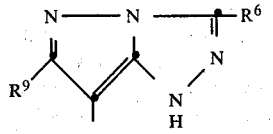

where:

$R^6$ is a ballast group, $R^9$ is halogen, lower alkyl, lower alkoxy, phenyl or substituted phenyl (e.g., 2,4,6-trihalophenyl), and $R^{10}$ is a blocking group which is removable during processing, such as an acyl group or a soluble coupler moiety.

Representative couplers of this invention are shown below:

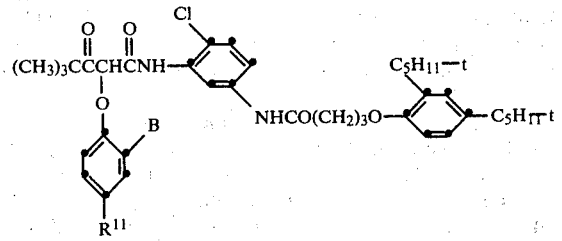

| Coupler No. | B | $R^{11}$ |
|---|---|---|
| 1 | $-NHC(=O)CH_3$ | $-C(=O)CH_3$ |
| 2 | $-N(CH_3)C(=O)CF_3$ | $-C(=O)CH_3$ |
| 3 | $-C(=O)NH_2$ | $-H$ |
| 4 | $-C(=O)NHCH_2CH_2OH$ | $-H$ |
| 5 | $-NHC(=O)CH_3$ | $-H$ |
| 6 | $-NHSO_2CH_3$ | $-C(=O)CH_3$ |
| 7 | $-NHC(=O)CF_3$ | $-C(=O)CH_3$ |
| 8 | $-C(=O)N(CH_3)_2$ | $-H$ |
| 9 | $-C(=O)N(CH_3)C_6H_5$ | $-H$ |
| 10 | $-SO_2CH_3$ | $-H$ |
| 11 | $-C(=O)NHCH_3$ | $-H$ |
| 12 | $-CH_2NHC(=O)CH_3$ | $-H$ |
| 13 | $-C(=O)NH-C_6H_4-SO_2NH_2$ | $-H$ |
| 14 | 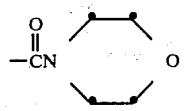 | $-H$ |
| 15 | $-NHC(=O)CH_3$ | $-SO_2NHCH_2CH_2OH$ |
| 16 | 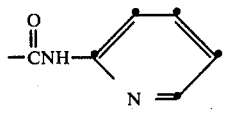 | $-H$ |
| 17 | $-C(=O)NHNHC(=O)NH_2$ | $-H$ |

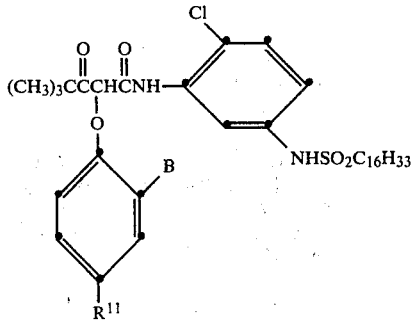

| Coupler No. | B | $R^{11}$ |
|---|---|---|

-continued

| | | |
|---|---|---|
| 18 | $-NHC(=O)CH_3$ | $-C(=O)CH_3$ |
| 19 | $-C(=O)NH_2$ | $-H$ |
| 20 | $-NHC(=O)CH_3$ | $-SO_2NHCH_2CH_2OH$ |
| 21 | $-C(=O)N(CH_3)_2$ | $-H$ |
| 22 | $-C(=O)NHCH_3$ | $-H$ |
| 23 | $-C(=O)NHCH_2CH_2OH$ | $-H$ |
| 24 | $-NHSO_2CH_3$ | $-C(=O)CH_3$ |

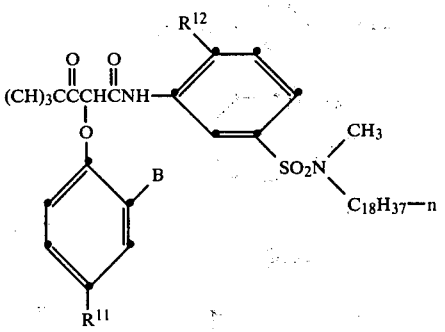

| Coupler No. | B | $R^{11}$ | $R^{12}$ |
|---|---|---|---|
| 25 | $-NHC(=O)CH_3$ | $-C(=O)CH_3$ | $-Cl$ |
| 26 | $-NHC(=O)CH_3$ | $-C(=O)CH_3$ | $-OCH_3$ |
| 27 | 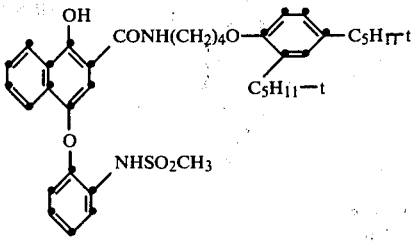 | | |

-continued

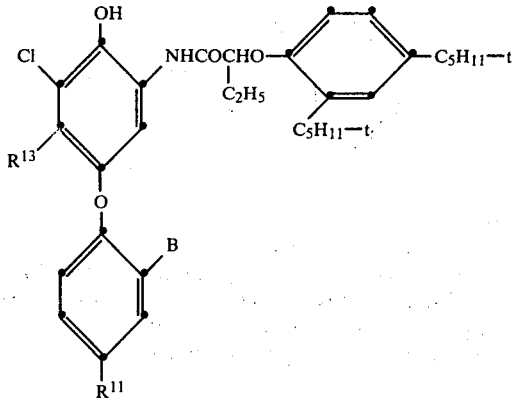

| Coupler No. | B | $R^{11}$ | $R^{13}$ |
|---|---|---|---|
| 28 | $-NHC(=O)CH_3$ | $-C(=O)COC_4H_9-n$ | $-CH_3$ |
| 29 | $-NHC(=O)CH_3$ | $-C(=O)COH$ | $-CH_3$ |
| 30 | $-NHC(=O)CH_3$ | H | $-C_2H_5$ |

Couplers of this invention can be prepared by condensing a coupler having a halogen (e.g., chloro) coupling-off group with an appropriately ortho substituted phenol or naphthol in the presence of an acid acceptor. Alternatively, a halogen derivative of the phenol or naphthol can be condensed with coupler, or precursor thereof, which has a hydroxy group in the coupling position, other reactive positions on the coupler being blocked until after attachment of the coupling-off group. Representative preparations of couplers are shown in the preparative examples, infra.

The couplers of this invention can be used in the ways and for the purposes that couplers are used in the photographic art. Those couplers which are ballasted, and hence immobile in the layers of photographic elements, can be associated with a silver halide emulsion layer, while those couplers which are diffusible can be incorporated in silver halide developer compositions and brought into contact with the silver halide emulsion during processing.

Preferably, the couplers are incorporated in silver halide emulsions and the emulsions coated on a support to form a photographic element. Alternatively, the couplers can be incorporated in photographic elements adjacent the silver halide emulsion where, during development, the coupler will be in reactive association with development products such as oxidized color developing agent. Thus, as used herein, the term "associated therewith" signifies that the coupler is in a silver halide emulsion layer or in an adjacent location where, during processing, it will come into reactive association with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Ser. No. 184,714 filed Sept. 8, 1980.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference is be made to *Research Disclosure,* December 1978, Item 17643, published by Industrial Opportunities Ltd., Homewell Havant, Hampshire, P09 1EF, U.K., the disclosures of which are incorporated herein by reference. This publication is identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the corlor developing agent. Oxidized color developing agent in turn reacts with the coupler to yield a dye.

Preferred color developing agents are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethyl-aniline hydrochloride and 4-amino-N-ethyl-N(2-methoxyethyl)-m-toluidine di-p-toluene sulfonic acid.

With negative-working silver halide this processing step leads to a negative image. To obtain a positive (or reversal) image, this step can be preceded by development with a non-chromogenic developing agent to develop exposed silver halide, but not form dye, then uniformly fogging the element to render unexposed silver halide developable, followed by development in with a chromogenic developer. Alternatively, a direct-positive emulsion can be employed to obtain a positive image.

Development is followed by the conventional steps of bleaching, fixing, or bleach-fixing, to remove silver and silver halide, washing and drying.

The following examples further illustrate this invention.

PREPARATIVE EXAMPLE 1

Preparation of Coupler No. 12

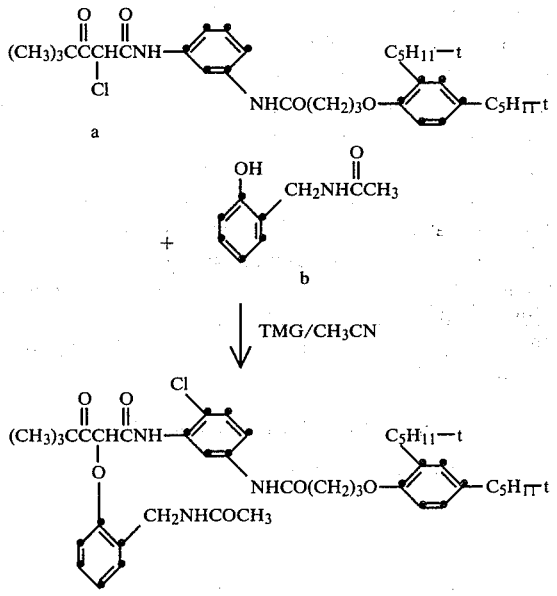

Coupler No. 12

To a slurry of 18.2 g (0.03 mol) of a and 5.1 g (0.03 mol) of 2-acetamidomethylphenol b in 50 ml acetonitrile, 7.0 g (0.06 mol) of tetramethylguanidine (TMG) was added with stirring. The reaction mixture was stirred at room temperature overnight. The precipitated salt was collected, washed with cold ethyl acetate and then taken to 200 ml with methanol. The solution was poured slowly into an ice-water hydrochloric acid mixture to decompose the salt to the coupler. Recrystallization from ethyl acetate gave 10.0 g (45%) of white solid product; m.p. 177°-181° C.

PREPARATIVE EXAMPLE 2

Preparation of Coupler No. 24

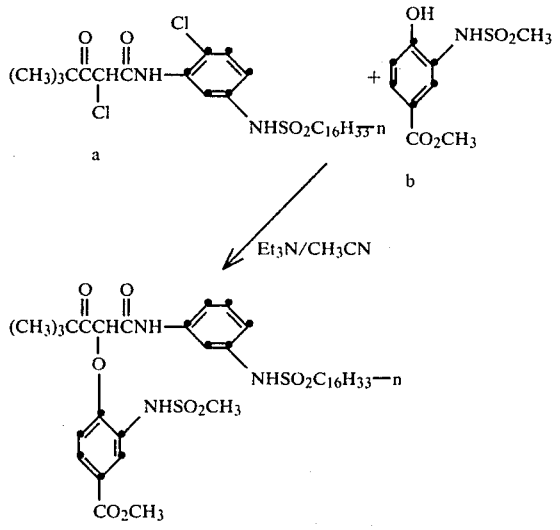

Coupler No. 24

To a solution of 19.5 g (0.033 mol.) of a and 6.7 g (0.064 mol) of triethylamine in 150 ml acetonitrile was added with stirring 8.1 g (0.033 mol) of methyl-3-methanesulfonamido-4-hydroxy benzoate b. The mixture was heated with stirring on a steam bath for 3 hours. After cooling, the mixture was poured into ice-water containing 5 ml concentrated hydrochloric acid. The gummy solid was collected, triturated with water and dried. The crude product was chromatographed through a silica gel column eluting with dichloromethane. The fractions containing the pure product were combined and the solvent removed under reduced pressure to give a white residue. Recrystallization from isopropyl alcohol gave 16 g (61%) of white solid; m.p. 96°-97° C.

PREPARATIVE EXAMPLE 3

Preparation of Coupler Nos. 28 and 29

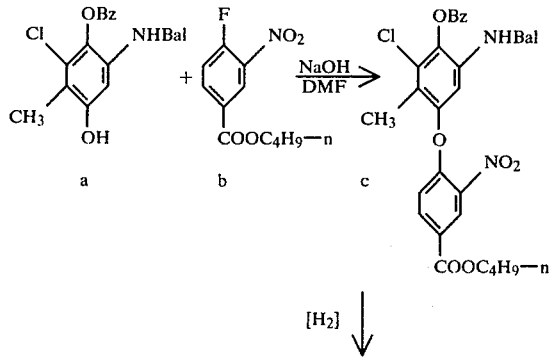

-continued

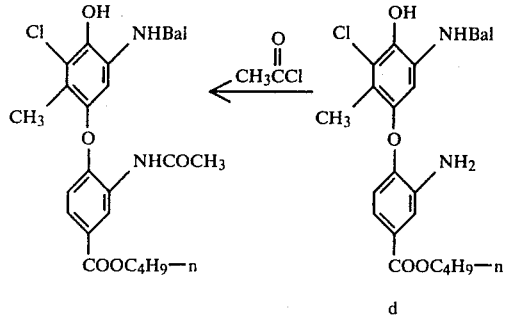

Coupler No. 28

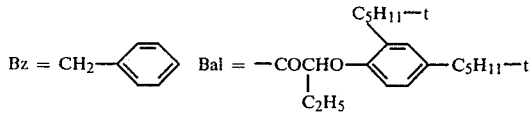

To a stirred solution of 17 g (0.03 mol) of a in 100 ml dimethylformamide was added an equivalent amount of 50% sodium hydroxide solution and 7.2 g (0.03 mol) of b. After stirring 2 hours at room temperature, the mixture was poured into ice-water containing 15 ml concentrated hydrochloric acid. The crude product c was collected, washed and dried, then dissolved in 150 ml tetrahydrofuran and reduced with 40 psi hydrogen over a palladium on charcoal catalyst. To the solution of product d, after removal of the catalyst by filtration, was added with stirring 8 ml acetyl chloride and 8 ml quinoline. After stirring 1 hour this mixture was poured into ice-water containing 15 ml concentrated hydrochloric acid and the resultant solid was purified on a silica gel column to obtain 4.5, Coupler No. 28, mp. 194°-5° C.

A portion of Coupler No. 28 was hydrolyzed in alcoholic aqueous sodium hydroxide solution to yield the corresponding p-COOH compound, Coupler No. 29, mp. 234°-235° C., after recrystallization from acetonitrile.

EXAMPLES 1-45

To demonstrate the unexpected results obtained from the couplers of this invention, a series of photographic elements was prepared to compare inventive couplers containing ortho-substituted aryloxy groups in their coupling position with analogous couplers containing para-substituted aryloxy groups.

Additional photographic elements were prepared in this series to demonstrate that not all ortho-substituents provide improved sensitometric results when compared to their para-substituted analogs.

The elements were prepared by coating a poly(ethyleneterephthalate) film support with (1) a photosensitive layer containing a silver bromoiodide emulsion at 0.75 g Ag/m$^2$, gelatin at 3.78 g/m$^2$, and one of the couplers identified below dispersed in one-half its weight of di-n-butylphthalate and coated at $2.7\times10^{-3}$ moles/m$^2$ and (2) an overcoat layer containing gelatin at 1.08 g/m$^2$ and bis-vinylsulfonylmethyl ether hardener at 1.0 weight percent based on total gelatin.

Samples of each of the photographic elements were imagewise exposed through a graduated density test object and developed for $2\frac{3}{4}$ minutes at 40° C. in one of the following developer solution.

| Developer Solution | |
|---|---|
| 4-Amino-3-methyl-N—ethyl-N—β-methane-sulfonamido)ethylaniline sulfate | 5.0 g |
| Potassium sulfite | 2.0 g |
| Potassium carbonate (anhydrous) | 30.0 g |
| Potassium bromide | 1.25 g |
| Potassium iodide | 0.6 mg |
| Water to: | 1.0 l |
| pH adjusted to: | 10.0 |

After development, each strip was stopped, washed, bleached, washed, fixed, washed and dried by conventional means. After processing, each element was sensitometrically evaluated by plotting color density vs. log exposure sensitometric curves and recording maximum density ($D_{max}$) and gamma ($\gamma$). Gamma is the slope of the straight line portion of the sensitometric curve. The higher the density and gamma, the more reactive the coupler.

In Tables I and II results are reported for couplers of this invention compared with control couplers which either omit the ortho position substituent or place it in the para position of the coupling-off group. It will be observed that the inventive couplers are significantly more reactive.

TABLE I

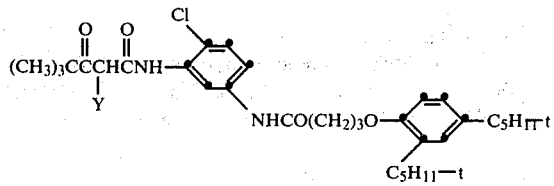

| Example | Coupler No. | Y | $D_{max}$ | $\gamma$ |
|---|---|---|---|---|
| 1 | 1 | 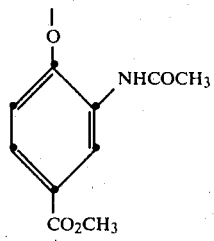 | 2.65 | 0.89 |
| 2 | C-1 | 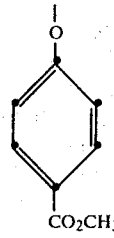 | 1.52 | 0.51 |

TABLE I-continued

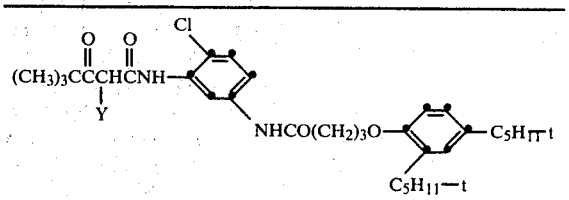

| Example | Coupler No. | Y | $D_{max}$ | $\gamma$ |
|---|---|---|---|---|
| 3 | C-2 | 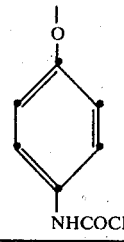 | 0.76 | 0.28 |

TABLE II

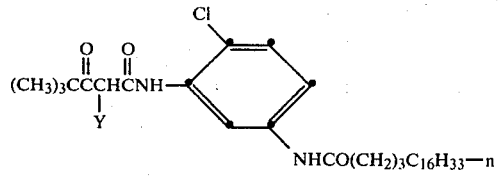

| Example | Coupler No. | Y | $D_{max}$ | $\gamma$ |
|---|---|---|---|---|
| 4 | 18 | 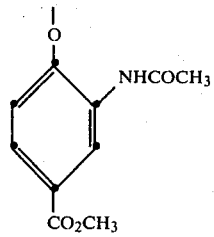 | 3.16 | 1.02 |
| 5 | C-3 | 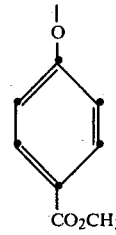 | 2.64 | 0.72 |
| 6 | C-4 | 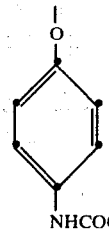 | 2.08 | 0.54 |

In Tables III and IV results are reported for couplers of the invention compared with couplers with the same polarizable group in the para position of the coupling-off group. In Table V results are reported for couplers outside the scope of the invention having the same non-polarizable group in each of the ortho and para positions of the coupling-off group. From Tables III and IV it will be observed that couplers of the invention are significantly more reactive than control couplers which contain a polarizable group in the para position, whereas from Table V it will be observed that there is no significant difference in reactivity between couplers in which the same non-polarizable substituent is in either the ortho or para position. Further, it will be observed from a comparison of Tables III and IV with Table V that couplers of the invention are more reactive than couplers with non-polarizable groups in the ortho position of the coupling-off group. The couplers employed in Tables III and V have the basic structure:

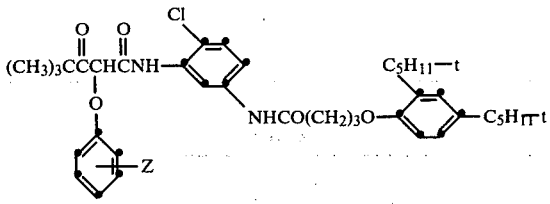

The couplers employed in Table IV have the basic structure:

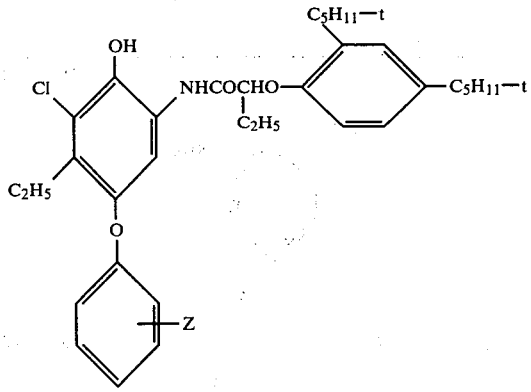

TABLE III

| Example | Coupler No. | Z | $D_{max}$ | γ |
|---|---|---|---|---|
| 7 | 4 | o-$CONHCH_2CH_2OH$ | 2.91 | 0.89 |
| 8 | C-5 | p-$CONHCH_2CH_2OH$ | 1.59 | 0.47 |
| 9 | 5 | o-$NHCOCH_3$ | 1.48 | 0.38 |
| 10 | C-6 | p-$NHCOCH_3$ | 1.01 | 0.27 |
| 11 | 10 | o-$SO_2CH_3$ | 1.61 | 0.41 |
| 12 | C-7 | p-$SO_2CH_3$ | 1.35 | 0.38 |
| 13 | 12 | o-$CH_2NHCOCH_3$ | 1.51 | 0.47 |
| 14 | C-8 | p-$CH_2NHCOCH_3$ | 0.98 | 0.30 |

TABLE IV

| Example | Coupler No. | Z | $D_{max}$ | γ |
|---|---|---|---|---|
| 15 | 30 | o-$NHCOCH_3$ | 1.84 | 0.52 |
| 16 | C-9 | p-$NHCOCH_3$ | 1.35 | 0.36 |

TABLE V

| Example | Coupler No. | Z | $D_{max}$ | γ |
|---|---|---|---|---|
| 17 | C-10 | o-$CH_3$ | 0.39 | 0.10 |
| 18 | C-11 | p-$CH_3$ | 0.64 | 0.16 |
| 19 | C-12 | o-$OCH_3$ | 0.26 | 0.05 |

TABLE V-continued

| Example | Coupler No. | Z | $D_{max}$ | γ |
|---|---|---|---|---|
| 20 | C-13 | p-$OCH_3$ | 0.33 | 0.07 |
| 21 | C-14 | o-Cl | 1.12 | 0.27 |
| 22 | C-15 | p-Cl | 1.23 | 0.32 |
| 23 | C-16 | o-F | 0.87 | 0.22 |
| 24 | C-17 | p-F | 0.81 | 0.22 |
| 25 | C-18 | o-$SCH_3$ | 0.31 | 0.07 |
| 26 | C-19 | p-$SCH_3$ | 0.37 | 0.08 |
| 27 | C-20 | o-$CH_2OH$ | 1.20 | 0.38 |
| 28 | C-21 | p-$CH_2OH$ | 1.20 | 0.38 |
| 29 | C-22 | H | 0.75 | 0.19 |

Results obtained with additional couplers of this invention are reported in Table VI.

TABLE VI

| Example | Coupler No. | $D_{max}$ | γ |
|---|---|---|---|
| 30 | 2 | 1.86 | 0.82 |
| 31 | 3 | 2.26 | 0.83 |
| 32 | 6 | 2.62 | 1.48 |
| 33 | 7 | 2.11 | 0.99 |
| 34 | 8 | 1.69 | 0.51 |
| 35 | 11 | 2.11 | 0.67 |
| 36 | 13 | 2.10 | 1.02 |
| 37 | 14 | 1.45 | 0.61 |
| 38 | 17 | 2.65 | 1.77 |
| 39 | 18 | 3.15 | 1.02 |
| 40 | 19 | 3.04 | 2.13 |
| 41 | 20 | 3.19 | 2.82 |
| 42 | 21 | 2.99 | 1.40 |
| 43 | 22 | 3.20 | 1.68 |
| 44 | 28 | 2.24 | — |
| 45 | 29 | 2.24 | — |

This invention has been described in detail with particular reference to preferred embodiments thereof, but it will be understood that variations and modifications can be effected within the spirit and scope of the invention.

What is claimed is:

1. A photographic element comprising a support and a silver halide emulsion having associated therewith a dye-forming coupler having the structure:

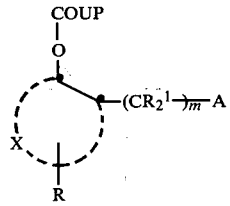

where:

COUP represents a dye-forming coupler moiety substituted in its coupling position with the remainder of the structure;

X represents the atoms to complete a phenyl nucleus free of groups which are capable of undergoing coupling;

R is hydrogen or one or more substituents selected from the group consisting of halogen, alkyl, alkoxy, nitro, cyano, carboxy, alkoxycarbonyl, aryloxycarbonyl, alkylsulfonyl, arylsulfonyl, amido, carbamoyl, sulfonamido and sulfamoyl;

$R^1$ is hydrogen or alkyl of 1 to 4 carbon atoms;

m is 0 to 4; and

A is a moiety containing a polarizable carbonyl, sulfonyl or phosphinyl group free of photographic dye groups and photographic reagent groups which are released during photographic processing.

2. A photographic element comprising a support and a silver halide emulsion having associated therewith a dye-forming coupler having the structure:

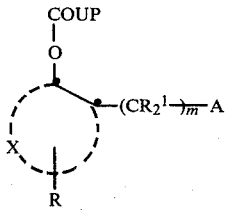

where:

COUP represents a dye-forming coupler moiety substituted in its coupling position with the remainder of the structure;

X represents the atoms to complete a phenyl nucleus free of groups which are capable of undergoing coupling;

R is hydrogen or one or more substituents selected from halogen, alkyl, alkoxy, nitro, cyano, carboxy, alkoxycarbonyl, aryloxycarbonyl, alkylsulfonyl, arylsulfonyl, amido ($-NR^1COR^2$), carbamoyl ($-CONR^3R^4$), sulfonamido ($-NR^1SO_2R^2$) and sulfamoyl ($-SO_2NR^3R^4$);

m is 0 to 4; and

A is a moiety containing a polarizable carbonyl, sulfonyl or phosphinyl group selected from $$-\overset{O}{\overset{\|}{C}}OR^2,\ -\overset{O}{\overset{\|}{C}}NR^3R^4,\ -\overset{O}{\overset{\|}{C}}NR^1NR^1\overset{O}{\overset{\|}{C}}NR^3R^4,\ -NR^1\overset{O}{\overset{\|}{C}}R^2,$$

$$-NR^1\overset{O}{\overset{\|}{C}}NR^3R^4,\ -SO_2R^2,\ -SO_2NR^3R^4,\ -NR^1SO_2R^2,$$

$$-NR^1SO_2NR^3R^4 \text{ and } -\overset{O}{\overset{\|}{P}}(R^5)_2;$$

$R^1$ is hydrogen or alkyl of 1 to 4 carbon atoms;

$R^2$ is hydrogen, alkyl or aryl;

$R^3$ and $R^4$ are each, individually, hydrogen, alky, aryl or heterocyclyl, or together $R^3$ and $R^4$ complete a heterocyclic ring with the nitrogen atom to which they are attached; and each $R^5$ is, individually, alkyl, alkoxy, aryl or aryloxy.

3. A photographic element of claim 2 wherein:

m is 0 or 1;

R is hydrogen or is a para position substituent selected from carboxy, alkoxy, alkoxycarbonyl, hydroxyalkyl and hydroxyalkylsulfamoyl;

$R^1$ is hydrogen;

A is $-NHCOR^2$, $-CONR^3R^4$, $-SO_2R^2$, $-NHSO_2R^2$ or $-SO_2NR^3R^4$;

$R^2$ is alkyl or hydroxyalkyl of 1 to 4 carbon atoms; and one of $R^3$ and $R^4$ is hydrogen and the other is alkyl or hydroxyalkyl of 1 to 4 carbon atoms.

4. A photographic element of claim 1 or 2 wherein COUP is an acetoacetanilide yellow dye-forming coupler moiety.

5. A photographic element of claim 1 or 2 wherein COUP is a phenol or naphthol cyan dye-forming coupler moiety.

6. A photographic element of claim 1 or 2 wherein COUP is a pyrazolone or pyrazolotriazole magenta dye-forming coupler moiety.

7. A photographic element of claim 1 wherein the dye-forming coupler has one of the structures:

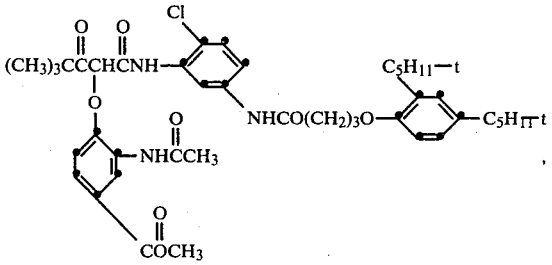

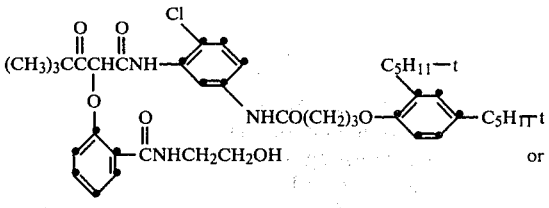

or

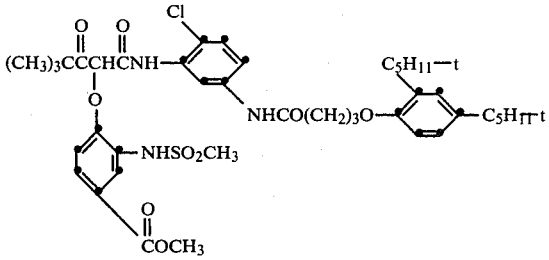

8. A photographic element of claim 1 wherein the dye-forming coupler has one of the structures:

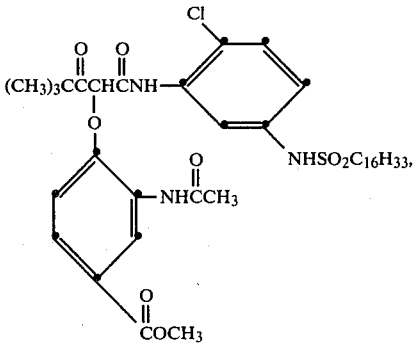

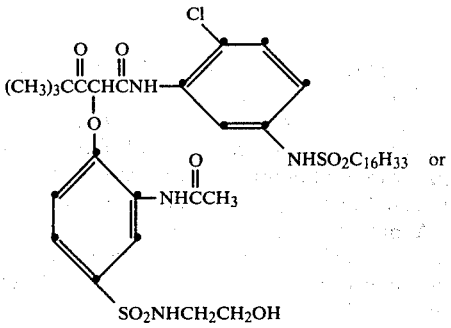

or

-continued

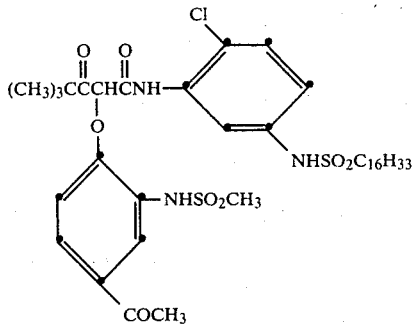

9. a multicolor photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the dye-forming couplers being a coupler of claim 1 or 2.

10. A process of developing an image in a photographic element comprising a support and a silver halide emulsion containing an imagewise distribution of developable silver halide grains, the process comprising the step of developing the element with a silver halide color developing agent in the presence of a dye-forming coupler having the structure:

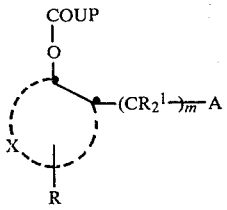

where:

COUP represents a dye-forming coupler moiety substituted in its coupling position with the remainder of the structure;

X represents the atoms to complete a phenyl nucleus free of groups which are capable of undergoing coupling;

R is hydrogen or one or more substituents selected from the group consisting of halogen, alkyl, alkoxy, nitro, cyano, carboxy, alkoxycarbonyl, aryloxycarbonyl, alkylsulfonyl, arylsulfonyl, amido, carbamoyl, sulfonamido and sulfamoyl;

$R^1$ is hydrogen or alkyl of 1 to 4 carbon atoms;

m is 0 to 4; and

A is a moiety containing a polarizable carbonyl, sulfonyl or phosphinyl group free of photographic dye groups and photographic reagent groups which are released during photographic processing.

11. A process of developing an image in a photographic element comprising a support and a silver halide emulsion containing an imagewise distribution of developable silver halide grains, the process comprising the step of developing the element with a silver halide color developing agent in the presence of a dye-forming coupler having the structure:

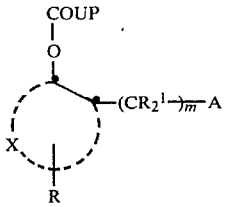

where:

COUP represents a dye-forming coupler moiety substituted in its coupling position with the remainder of the structure;

X represents the atoms to complete a phenyl nucleus free of groups which are capable of undergoing coupling;

m is 0 to 4;

R is hydrogen or one or more substituents selected from halogen, alkyl, alkoxy, nitro, cyano, carboxy, alkoxycarbonyl, aryloxycarbonyl, alkylsulfonyl, arylsulfonyl, amido ($-NR^1COR^2$), carbamoyl ($-CONR^3R^4$), sulfonamido ($-NR^1SO_2R^2$) and sulfamoyl ($-SO_2NR^3R^4$);

A is a moiety containing a polarizable carbonyl, sulfonyl or phosphinyl group selected from $$-\overset{O}{\overset{\|}{C}}OR^2,\ -\overset{O}{\overset{\|}{C}}NR^3R^4,\ -\overset{O}{\overset{\|}{C}}NR^1NR^1\overset{O}{\overset{\|}{C}}NR^3R^4,\ -NR^1\overset{O}{\overset{\|}{C}}R^2,$$

$$-NR^1\overset{O}{\overset{\|}{C}}NR^3R^4,\ -SO_2R^2,\ -SO_2NR^3R^4,\ -NR^1SO_2R^2,$$

$$-NR^1SO_2NR^3R^4 \text{ and } -\overset{O}{\overset{\|}{P}}(R^5)_2;$$

$R^1$ is hydrogen or alkyl of 1 to 4 carbon atoms;

$R^2$ is hydrogen, alkyl or aryl;

$R^3$ and $R^4$ are each, individually, hydrogen, alkyl, aryl or heterocyclyl, or together $R^3$ and $R^4$ complete a heterocyclic ring with the nitrogen atom to which they are attached; and each $R^5$ is, individually, alkyl, alkoxy, aryl or aryloxy.

12. A process of claim 11 wherein:

m is 0 or 1;

R is hydrogen or is a para position substituent selected from carboxy, alkoxy, alkoxycarbonyl, hydroxyalkyl and hydroxyalkylsulfamoyl;

$R^1$ is hydrogen;

A is $-NHCOR^2$, $-CONR^3R^4$, $-SO_2R^2$, $-NHSO_2R^2$ or $-SO_2NR^3R^4$;

$R^2$ is alkyl or hydroxyalkyl of 1 to 4 carbon atoms; and one of $R^3$ and $R^4$ is hydrogen and the other is alkyl or hydroxyalkyl of 1 to 4 carbon atoms.

13. A process of claim 10 or 11 wherein COUP is an acetoacetanilide yellow dye-forming coupler moiety.

14. A process of claim 10 or 11 wherein COUP is a phenol or naphthol cyan dye-forming coupler moiety.

15. A process of claim 10 or 11 wherein COUP is a pyrazolone or pyrazolotriazole magenta dye-forming coupler moiety.

16. A photographic silver halide emulsion containing a dye-forming coupler having the structure:

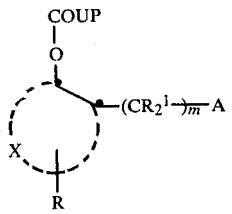

where:

COUP represents a dye-forming coupler moiety substituted in its coupling position with the remainder of the structure;

X represents the atoms to complete a phenyl nucleus free of groups which are capable of undergoing coupling;

R is hydrogen or one or more substituents selected from the group consisting of halogen, alkyl, alkoxy, nitro, cyano, carboxy, alkoxycarbonyl, aryloxycarbonyl, alkylsulfonyl, arylsulfonyl, amido, carbamoyl, sulfonamido and sulfamoyl;

$R^1$ is hydrogen or alkyl of 1 to 4 carbon atoms;

m is 0 to 4; and

A is a moiety containing a polarizable carbonyl, sulfonyl or phosphinyl group free of photographic dye groups and photographic reagent groups which are released during photographic processing.

17. A photographic silver halide emulsion containing a dye-forming coupler having the structure:

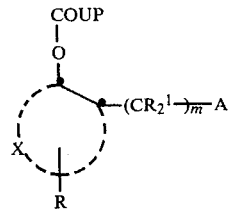

where:

COUP represents a dye-forming coupler moiety substituted in its coupling position with the remainder of the structure;

X represents the atoms to complete a phenyl nucleus free of groups which are capable of undergoing coupling;

m is 0 to 4;

R is hydrogen or one or more substituents selected from the group consisting of halogen, alkyl, alkoxy, nitro, cyano, carboxy, alkoxycarbonyl, aryloxycarbonyl, alkylsulfonyl, arylsulfonyl, amido, carbamoyl, sulfonamido and sulfamoyl;

$R^1$ is hydrogen or alkyl of 1 to 4 carbon atoms; and

A is a moiety containing a polarizable carbonyl, sulfonyl or phosphinyl group free of photographic dye groups and photographic reagent groups which are released during photographic processing.

18. An emulsion of claim 17 wherein:

m is 0 or 1;

R is hydrogen or is a para position substituent selected from carboxy, alkoxy, alkoxycarbonyl, hydroxyalkyl and hydroxyalkylsulfamoyl;

$R^1$ is hydrogen;

A is $-NHCOR^2$, $-CONR^3R^4$, $-SO_2R^2$, $-NHSO_2R^2$ or $-SO_2NR^3R^4$;

$R^2$ is alkyl or hydroxyalkyl of 1 to 4 carbon atoms; and one of $R^3$ and $R^4$ is hydrogen and the other is alkyl or hydroxyalkyl of 1 to 4 carbon atoms.

* * * * *